US009234696B2

(12) United States Patent
Youn et al.

(10) Patent No.: US 9,234,696 B2
(45) Date of Patent: Jan. 12, 2016

(54) REFRIGERATOR

(75) Inventors: Deok-Hyun Youn, Gimhae-si (KR); Ju-Hyun Kim, Jinhae-si (KR); Sang-Ho Oh, Daegu (KR); Cheol-Hwan Kim, Changwon-si (KR); Hoon-Bong Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1201 days.

(21) Appl. No.: 13/139,935

(22) PCT Filed: Dec. 10, 2009

(86) PCT No.: PCT/KR2009/007395
§ 371 (c)(1),
(2), (4) Date: Sep. 2, 2011

(87) PCT Pub. No.: WO2010/071323
PCT Pub. Date: Jun. 24, 2010

(65) Prior Publication Data

US 2011/0308264 A1 Dec. 22, 2011

(30) Foreign Application Priority Data

Dec. 16, 2008 (KR) ..... 10-2008-0128098
Jan. 8, 2009 (KR) ..... 10-2009-0001664
Jan. 8, 2009 (KR) ..... 10-2009-0001669
Nov. 10, 2009 (KR) ..... 10-2009-0108310

(51) Int. Cl.
*F25D 17/00* (2006.01)
*F25D 29/00* (2006.01)
*F25D 17/06* (2006.01)

(52) U.S. Cl.
CPC ..... *F25D 29/00* (2013.01); *F25D 17/062* (2013.01); *F25D 2317/061* (2013.01); *F25D 2600/04* (2013.01)

(58) Field of Classification Search
CPC ... Y10S 165/918; Y10S 165/919; A23L 3/36; A47B 2031/026; F25D 23/062; F25D 29/00; F25D 2317/061; F25D 2600/04
USPC ..... 165/205, 202, 919, 918, 203, 42, 43, 165/48.1
See application file for complete search history.

(56) References Cited

U.S. PATENT DOCUMENTS 2,091,292 A * 8/1937 Scurlock ..... 165/58
2,597,745 A * 5/1952 Morrison ..... 165/240
(Continued)

FOREIGN PATENT DOCUMENTS

EP 1808658 A2 7/2007
EP 1813894 A2 8/2007
(Continued)

*Primary Examiner* — Ljiljana Ciric
*Assistant Examiner* — Alexis Cox
(74) *Attorney, Agent, or Firm* — Birch, Stewart, Kolasch & Birch, LLP

(57) ABSTRACT

A refrigerator controls the temperature of an upper space and a lower space. A heat source supplier provides heat in the upper space. A control unit controls the heat source supplier based on the sensed temperature from a temperature sensor to maintain the temperature of the upper space to be higher than the temperature of the lower space, and control a cooling circuit to maintain the temperature of the lower space to be below the temperature of a maximum ice crystal formation zone of water and the temperature of the upper space to be over the temperature of the maximum ice crystal formation zone of water, thus maintaining a supercooled state of a stored liquid in the container as a preset state during a first time period.

8 Claims, 13 Drawing Sheets

(56) References Cited

U.S. PATENT DOCUMENTS

| | | | | |
|---|---|---|---|---|
| 3,205,033 | A * | 9/1965 | Stentz | 312/236 |
| 3,682,643 | A * | 8/1972 | Foster | 426/233 |
| 3,736,981 | A * | 6/1973 | Shevlin | 165/206 |
| 4,285,391 | A * | 8/1981 | Bourner | 165/61 |
| 6,354,102 | B1 * | 3/2002 | Hozumi et al. | 62/340 |
| 7,086,459 | B2 * | 8/2006 | Beitelmal et al. | 165/205 |
| 8,196,648 | B2 * | 6/2012 | Matsukawa | 165/202 |
| 2002/0112488 | A1 * | 8/2002 | Daum et al. | 62/125 |
| 2004/0028786 | A1 * | 2/2004 | Tani et al. | 426/524 |
| 2008/0245081 | A1 * | 10/2008 | Shin et al. | 62/80 |
| 2008/0307823 | A1 * | 12/2008 | Lee et al. | 62/441 |
| 2009/0314012 | A1 * | 12/2009 | Lim et al. | 62/66 |
| 2010/0126202 | A1 * | 5/2010 | Flores et al. | 62/344 |
| 2010/0319368 | A1 * | 12/2010 | Kim et al. | 62/75 |
| 2011/0219800 | A1 * | 9/2011 | Lee | 62/186 |
| 2011/0264283 | A1 * | 10/2011 | Soh et al. | 700/282 |

FOREIGN PATENT DOCUMENTS

| | | | |
|---|---|---|---|
| JP | 2001-4260 | A | 1/2001 |
| JP | 2008-26764 | A | 11/2008 |
| KR | 10-0850062 | B1 | 8/2008 |
| WO | WO 2008/147160 | A2 | 12/2008 |

* cited by examiner

REFRIGERATOR

TECHNICAL FIELD

The present invention relates to a refrigerator, and, more particularly, to a refrigerator which can maintain a stored object in a desired state by controlling the temperature of an upper region and a lower region in the same storing space.

BACKGROUND ART

Supercooling means the phenomenon that a molten object or a solid is not changed although it is cooled to a temperature below the phase transition temperature in an equilibrium state. A material has a stable state at every temperature. If the temperature is slowly changed, the constituent elements of the material can follow the temperature changes, maintaining the stable state at each temperature. However, if the temperature is suddenly changed, since the constituent elements cannot be changed into the stable state at each temperature, the constituent elements maintain a stable state at an initial temperature, or some of the constituent elements fail to be changed into a state at a final temperature.

For example, when water is slowly cooled, it is not temporarily frozen at a temperature below 0° C. However, when water enters a supercooled state, it has a kind of quasi-stable state. As this unstable equilibrium state is easily broken even by slight stimulation, water tends to move into a more stable state. That is, if a small piece of the material is put into the supercooled liquid, or if the liquid is suddenly shaken, the liquid starts to be frozen at once such that its temperature reaches the freezing point, and maintains a stable equilibrium state at the temperature.

In general, an electrostatic atmosphere is made in a refrigerator, and meat and fish are thawed in the refrigerator at a minus temperature. In addition to the meat and fish, fruit is kept fresh in the refrigerator.

This technology uses a supercooling phenomenon. The supercooling phenomenon indicates the phenomenon that a molten object or a solid is not changed although it is cooled to a temperature below the phase transition temperature in an equilibrium state. In the prior art, an electric field or magnetic field is applied to the stored object to be cooled such that the stored object enters a supercooled state. Accordingly, a complicated apparatus for producing the electric field or magnetic field should be provided to store the stored object in the supercooled state, and the power consumption is increased during the production of the electric field or magnetic field. Additionally, the apparatus for producing the electric field or magnetic field should further include a safety device (e.g., an electric field or magnetic field shielding structure, an interception device, etc.) for protecting the user from high power, when producing or intercepting the electric field or magnetic field.

Japanese Patent Publication No. 2001-4260 describes a supercooling control refrigerator which includes a temperature detection means and a control means controlling the temperature at a given set temperature in an openable/closable insulation unit and which keeps the goods cold at a temperature below the freezing point during the supercooling operation. However, since the refrigerator controls the rotation number of a cool air circulation fan to adjust the temperature in the insulation unit, if the temperature in the unit is reduced to a temperature below the set temperature, there is no means for raising the temperature to the set temperature within a short time. When the temperature in the unit is maintained at a temperature below the set temperature for a predetermined time, the goods intended to be stored in a supercooled state are frozen. In addition, the frozen goods cannot be thawed and stored again in the supercooled state. The refrigerator has low stability in maintaining a non-frozen state.

Korean Registered Patent No. 10-850062 describes a refrigerator having a space for storing food and a storing room for cooling the space, the refrigerator including a cool air flowing space directly cooling the food storing space and an insulation layer insulating the cool air flowing space from the space, and storing the food in a supercooled state. However, if the temperature in the refrigerator is reduced to a temperature below a set temperature, there is no construction for raising the temperature. Therefore, the refrigerator also has low stability in maintaining a non-frozen state.

Japanese Patent Publication No. 2008-267646 describes a refrigerator with a supercooling room which includes a freezing chamber with a temperature control means therein to continuously adjust the temperature between 0° C. and a temperature of a freezing temperature zone by stages, the supercooling room disposed in the freezing chamber and receiving the cool air from the freezing chamber, and a control apparatus controlling the freezing chamber so that the food stored in the supercooling room can be maintained in a supercooled state at a temperature below the freezing point without being frozen. The temperature of the freezing chamber or a switching chamber in which the supercooling room is installed is controlled to adjust the temperature of the supercooling room. The supercooling room is sealed with respect to the freezing chamber or the switching chamber such that a temperature change in the supercooling room is limited. However, when the food is stored in the supercooled state by slowing down the temperature change in the supercooling room by indirect cooling, it takes a long time for the food to reach the supercooled state. Moreover, if the temperature in the refrigerator is reduced to a temperature below a set temperature, there is no construction for raising the temperature. Accordingly, the refrigerator also has low stability in maintaining a non-frozen state.

DISCLOSURE

Technical Problem

An object of the present invention is to provide a refrigerator and a temperature control apparatus of a storage room which can change a state of a stored object received or stored in a storing space to a desired state or maintain the stored object in the desired state by limiting the heat exchange between an upper space and a lower space in the same storing space.

Another object of the present invention is to provide a refrigerator and a temperature control apparatus of a storage room which can perform rapid cooling of a stored object, entering a supercooling temperature region, and maintaining the supercooling temperature region through the temperature control.

A further object of the present invention is to provide a refrigerator and a temperature control apparatus of a storage room which can store a stored object such as a liquid in a slush state, when the stored object is crystallized due to the phase transition.

A still further object of the present invention is to provide a refrigerator and a temperature control apparatus of a storage room which can store a stored object in a desired state by controlling an energy application degree with respect to an upper space and a lower space of a storing space.

A still further object of the present invention is to provide a temperature control apparatus of a storage room which can create a desired state independently from the control of a refrigerator.

A still further object of the present invention is to provide a refrigerator and a temperature control apparatus of a storage room which can allow quick cooling and perform a cooling process to generate the phase transition of a stored object such as a liquid of a supercooled state.

Technical Solution

According to an aspect of the present invention, there is provided a refrigerator including a non-freezing apparatus having a storage room with a storing space composed of an upper space and a lower space, the air or heat exchange being limited between the upper space and the lower space, and a temperature control unit controlling the temperature of the upper space and the lower space, wherein the non-freezing apparatus is installed in a storing space in which the cooling is performed and controls the temperature control unit to perform at least one of a process of rapid cooling at a temperature over the phase transition temperature, a process of entering a supercooling temperature region, and a process of maintaining the supercooling temperature region.

In addition, preferably, the non-freezing apparatus performs the process of entering the supercooling temperature region continuously to the process of rapid cooling.

Moreover, preferably, the non-freezing apparatus performs a process of raising the temperature, when the temperature of the upper space or the lower space is lower than the supercooling temperature region.

Further, preferably, the non-freezing apparatus performs the process of maintaining the supercooling temperature region continuously to the process of raising the temperature.

Furthermore, preferably, the non-freezing apparatus performs a process of keeping slush which raises the temperature of the storing space, when a liquid stored in the storing space is crystallized into slush.

Still furthermore, preferably, the non-freezing apparatus performs a process of releasing a supercooled state which causes the liquid stored in the storing space to be crystallized into slush due to the phase transition during the process of maintaining the supercooling temperature region.

Still furthermore, preferably, the process of releasing the supercooled state is performed by lowering the temperature of the storing space.

Still furthermore, preferably, the temperature control unit includes a first sub-temperature control unit sensing or adjusting the temperature of the upper space, or a second sub-temperature control unit sensing or adjusting the temperature of the lower space.

Still furthermore, preferably, the first and second sub-temperature control units include first and second heat source supply units, respectively.

Still furthermore, preferably, the first and second sub-temperature control units include first and second temperature sensing units sensing the temperature of the upper space and the lower space, respectively.

Still furthermore, preferably, the non-freezing apparatus includes an interception unit introducing the cool air from the storing space to at least the lower space or intercepting the cool air.

Still furthermore, preferably, the non-freezing apparatus includes a fan element provided at least in the lower space to circulate the air by a forcible convection.

Still furthermore, preferably, the non-freezing apparatus controls the first sub-temperature control unit or the second sub-temperature control unit according to the current process.

According to another aspect of the present invention, there is provided a temperature control apparatus of a storage room formed in or adjacent to a cooling space of a refrigerator, the temperature control apparatus including the storage room with a storing space composed of an upper space and a lower space, the air or heat exchange being limited between the upper space and the lower space, a temperature sensing unit sensing the temperature of at least one of the upper space and the lower space, and a heat source supply unit supplying heat to the upper space or the lower space or generating heat in the upper space or the lower space, wherein the temperature control apparatus controls the heat source supply unit based on the sensed temperature from the temperature sensing unit to maintain the temperature of the upper space and the temperature of the lower space to be the same or different, thus maintaining a state of a stored object as a preset state.

Advantageous Effects

An embodiment of the present invention can change a state of a stored object stored in a storing space to a desired state, particularly, a supercooled state or a slush state, or maintain the stored object in the desired state by limiting the heat exchange between an upper space and a lower space in the same storing space.

Another embodiment of the present invention can independently control a state of a stored object by performing a process of rapid cooling of the stored object, a process of entering a supercooling temperature region, a process of maintaining the supercooling temperature region, a process of raising the temperature, and a process of lowering the temperature through the temperature control.

A further embodiment of the present invention can store a stored object such as a liquid in a slush state, when the stored object is crystallized due to the phase transition, which makes it possible to store and maintain the stored object in various states.

A still further embodiment of the present invention can store a stored object in a desired state with high reliability by controlling an energy application degree with respect to an upper space and a lower space of a storing space.

A still further embodiment of the present invention can prevent an excessive control load from being exerted on the control of a refrigerator, by creating a desired state independently from the control of the refrigerator.

A still further embodiment of the present invention can allow quick cooling and generate the phase transition of a stored object such as a liquid of a supercooled state to enter and maintain a slush state desired by a user.

MODE FOR INVENTION

Hereinafter, the present invention will be described in detail with reference to the exemplary embodiments and the accompanying drawings.

Figure 1:
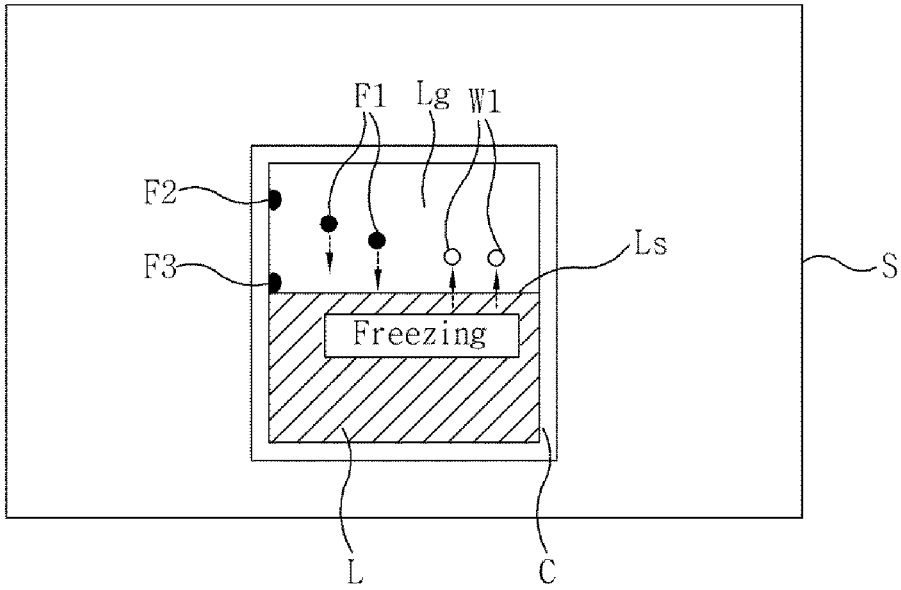
FIG. 1 is a view showing a process of forming ice crystal nucleuses in a liquid during the cooling.

FIG. 1 is a view showing a process of forming ice crystal nucleuses in a liquid during the cooling. As illustrated in FIG. 1, a container C containing a liquid L (or a stored object) is cooled in a storing unit S with a cooling space therein.

For example, it is assumed that a cooling temperature of the cooling space is lowered from a normal temperature to a temperature below 0° C. (the phase transition temperature of water) or a temperature below the phase transition temperature of the liquid L. While the cooling is carried out, it is intended to maintain a supercooled state of the water or the liquid L (or the stored object) at a temperature below the maximum ice crystal formation zone (−1° C. to −7° C.) of the water in which the formation of ice crystals is maximized, or at a cooling temperature below the maximum ice crystal formation zone of the liquid L.

The liquid L is evaporated during the cooling such that vapor W1 is introduced into a gas Lg (or a space) in the container C. In a case where the container C is closed, the gas Lg may be supersaturated due to the evaporated vapor W1.

When the cooling temperature reaches or exceeds a temperature of the maximum ice crystal formation zone of the liquid L, the vapor W1 forms ice crystal nucleuses F1 in the gas Lg or ice crystal nucleuses F2 on an inner wall of the container C. Alternatively, the condensation occurs in a contact portion of the surface Ls of the liquid L and the inner wall of the container C (almost the same as the cooling temperature of the cooling space) such that the condensed liquid L may form ice crystal nucleuses F3 which are ice crystals.

For example, when the ice crystal nucleuses F1 in the gas Lg are lowered and infiltrated into the liquid L through the surface Ls of the liquid L, the liquid L is released from the supercooled state and caused to be frozen. That is, the supercooling of the liquid L is released.

Alternatively, as the ice crystal nucleuses F3 are brought into contact with the surface Ls of the liquid L, the liquid L is released from the supercooled state and caused to be frozen.

As described above, according to the process of forming the ice crystal nucleuses F1 to F3, when the liquid L is stored at a temperature below its maximum ice crystal formation zone, the liquid L is released from the supercooled state due to the freezing of the vapor evaporated from the liquid L and existing on the surface Ls of the liquid L and the freezing of the vapor on the inner wall of the container C adjacent to the surface Ls of the liquid L.

Figure 2:
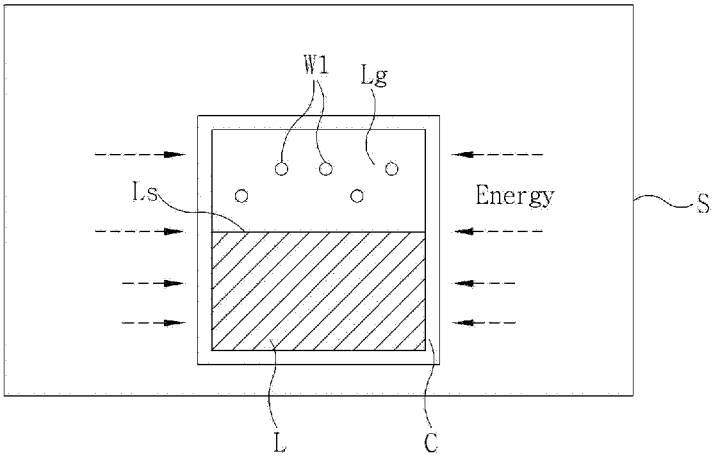
FIG. 2 is a view showing a process of preventing the ice crystal nucleus formation, which is applied to a temperature control apparatus (or a non-freezing apparatus) of a storage room according to the present invention.

FIG. 2 is a view showing a process of preventing the ice crystal nucleus formation, which is applied to a temperature control apparatus (or a non-freezing apparatus) of a storage room according to the present invention.

In FIG. 2, to prevent the freezing of the vapor W1 in the gas Lg, i.e., to continuously maintain the vapor W1 state, the energy is applied to at least the gas Lg or the surface Ls of the liquid L so that the temperature of the gas Lg or the surface Ls of the liquid L can be higher than a temperature of the maximum ice crystal formation zone of the liquid L, more preferably, the phase transition temperature of the liquid L. In addition, to prevent the freezing although the surface Ls of the liquid L is brought into contact with the inner wall of the container C, the temperature of the surface Ls of the liquid L is maintained higher than a temperature of the maximum ice crystal formation zone of the liquid L, more preferably, the phase transition temperature of the liquid L.

Accordingly, the liquid L in the container C maintains the supercooled state at a temperature below its phase transition temperature or a temperature below its maximum ice crystal formation zone.

Moreover, when the cooling temperature of the storing unit S is a considerably low temperature, e.g., −20° C., although the energy is applied to an upper portion of the container C, the liquid L which is the stored object may not be able to maintain the supercooled state. There is a need that the energy should be applied to a lower portion of the container C to some extent. When the energy applied to the upper portion of the container C is relatively larger than the energy applied to the lower portion of the container C, the temperature of the upper portion of the container C can be maintained higher than the phase transition temperature or a temperature of the maximum ice crystal formation zone. Further, the temperature of the liquid L in the supercooled state can be adjusted by the energy applied to the lower portion of the container C and the energy applied to the upper portion of the container C.

The liquid L has been described as an example with reference to FIGS. 1 and 2. In the case of a stored object containing a liquid, when the liquid in the stored object is continuously supercooled, the stored object can be kept fresh for an extended period of time. The stored object can be maintained in a supercooled state at a temperature below the phase transition temperature via the above process. Here, the stored object may include meat, vegetable, fruit and other food as well as the liquid.

Furthermore, the energy adopted in the present invention may be thermal energy, electric or magnetic energy, ultrasonic energy, light energy, and so on.

Figure 3:
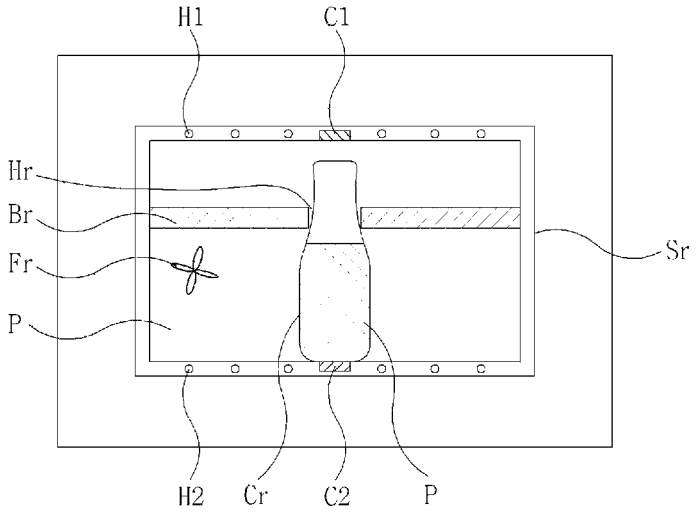
FIG. 3 is a schematic configuration view of the temperature control apparatus (or the non-freezing apparatus) of the storage room according to the present invention.

FIG. 3 is a schematic configuration view of the temperature control apparatus (or the non-freezing apparatus) of the storage room according to the present invention.

The temperature control apparatus of FIG. 3 includes a case Sr mounted in the storing unit S in which the cooling is performed, the case being a storage room with a storing space therein, a heat generation coil H1 mounted on the inside of a top surface of the case Sr and generating heat, a temperature sensor C1 sensing a temperature of an upper portion of the storing space, a heat generation coil H2 mounted on the inside of a bottom surface of the case Sr and generating heat, and a temperature sensor C2 sensing a temperature of the lower portion of the storing space or a temperature of a stored object P.

The temperature control apparatus is installed in the storing unit S such that the cooling is performed therein. The temperature sensors C1 and C2 sense the temperature and the heat generation coils H1 and H2 are turned on to supply heat from the upper and lower portions of the storing space to the storing space. The heat supply quantity is adjusted to control the temperature of the upper portion of the storing space (or the air on the stored object P) to be higher than a temperature of the maximum ice crystal formation zone, more preferably, the phase transition temperature.

Particularly, a boundary film Br is formed in the case Sr to separate upper and lower portions of the storing space and prevent the heat exchange between the upper and lower portions thereof. The boundary film Br includes a hole Hr through which a top end portion of a container Cr containing a liquid P is located in the upper portion of the storing space. The portion of the boundary film Br around the hole Hr is made of an elastic material to minimize the air flow, particularly, the heat flow between the upper and lower portions of the storing space. The upper portion of the container Cr passes through the hole Hr of the boundary film Br and is located in the upper portion of the storing space, and the lower portion of the container Cr is located in the lower portion of the storing space. The boundary film Br makes it easy to maintain the upper and lower portions of the storing space or the upper and lower portions of the container Cr at a desired temperature. The temperature sensor C2 is disposed on a bottom surface of the container Cr to accurately sense the temperature of the container Cr or the liquid which is the stored object P.

In addition, a fan element Fr is provided in the lower storing space of the case Sr to circulate the air and heat in the lower portion by a forcible convection. Accordingly, the heat supplied by the heat generation coil H2 can be evenly transferred to the lower storing space and the stored object.

Figure 4:
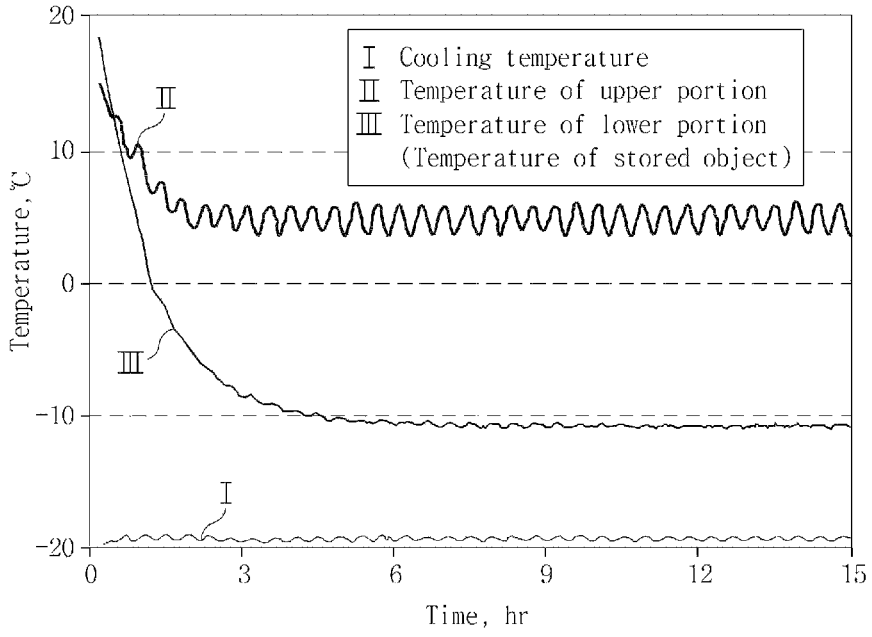
FIG. 4 is a graph showing a supercooled state of water using the temperature control apparatus (or the non-freezing apparatus) of the storage room of FIG. 3.

The positions of the heat generation coils H1 and H2 in FIG. 3 are appropriately determined to supply the heat (or energy) to the stored object P and the storing space. The heat generation coils H1 and H2 may be inserted into side surfaces of the case Sr. FIG. 4 is a graph showing a water temperature of the temperature control apparatus (or the non-freezing apparatus) of FIG. 3. The graph of FIG. 4 is a temperature graph when the liquid L is water and the principle of FIGS. 2 and 3 is applied thereto.

As illustrated in FIG. 4, line I represents a curve of the cooling temperature of the cooling space, line II represents a curve of the temperature of the gas Lg (air) on the surface of the water in the container C or the case Sr (or the temperature of the upper portion of the container C or the case Sr), and line III represents a curve of the temperature of the lower portion of the container C, the case Sr or the container Cr. A temperature of an outer surface of the container C, the case Sr or the container Fr is substantially identical to the temperature of the water or liquid in the container C, the case Sr or the container Cr.

As shown, in a case where the cooling temperature is maintained at about −19° C. to −20° C. (see line I), when the temperature of the gas Lg on the surface of the water in the container C is maintained at about 4° C. to 6° C. which is higher than a temperature of the maximum ice crystal formation zone of the water, the temperature of the water in the container C is maintained at about −11° C. which is lower than a temperature of the maximum ice crystal formation zone of the water, but the water is stably maintained in a supercooled state which is a liquid state for an extended period of time. Here, the heat generation coils H1 and H2 supply heat.

Additionally, in FIG. 4, the energy is applied to the surface of the water or the gas Lg on the surface of the water before the temperature of the water reaches a temperature of the maximum ice crystal formation zone, more preferably, the phase transition temperature due to the cooling. Thus, the water stably enters and maintains the supercooled state.

Figure 5:
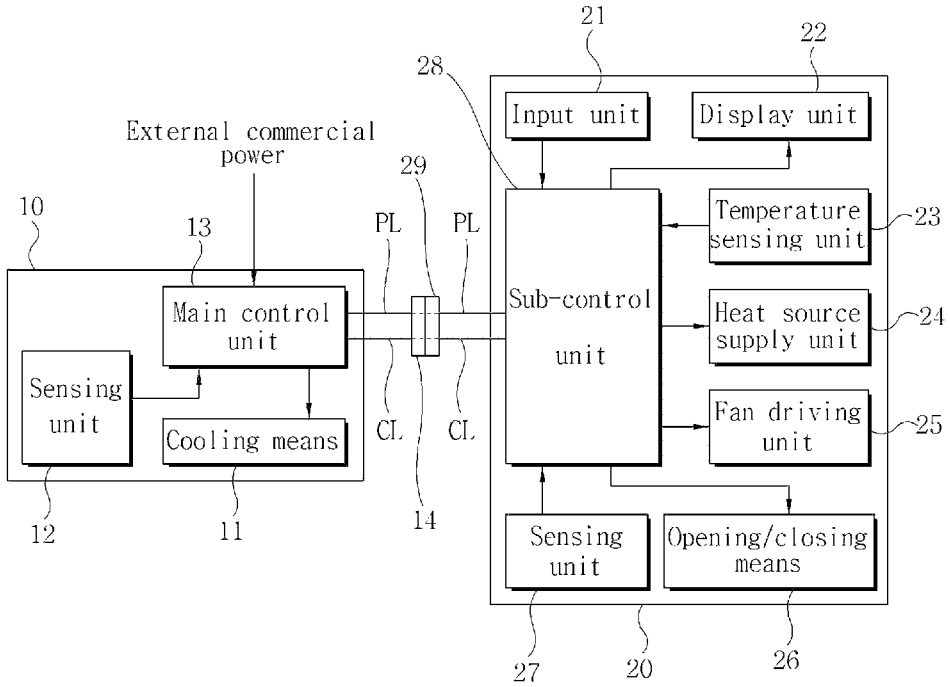
FIG. 5 is a schematic block diagram of a refrigerator employing a temperature control apparatus (or a non-freezing apparatus) of a storage room according to the present invention.

FIG. 5 is a schematic block diagram of a refrigerator employing a temperature control apparatus (or a non-freezing apparatus) of a storage room according to the present invention.

The refrigerator (or cooling apparatus) includes a main body apparatus 10, and the non-freezing apparatus 20 (or the temperature control apparatus of the storage room) mounted in the main body apparatus 10 (specifically, a storing unit, a storing space or a door provided in the main body apparatus 10) and cooled by the main body apparatus 10. The refrigerator may include a display device (not shown) installed on the storing unit door provided on the main body apparatus 10 and performing functions such as state display of the refrigerator and temperature setting.

The main body apparatus 10, which is composed of one or more storing units storing a stored object or a stored container and a bulkhead separating the plurality of storing units, includes a cooling means 11 cooling the storing unit, a sensing unit 12 sensing the temperature in the storing unit, the opening and closing of the storing unit door, etc., and a main control unit 13 receiving external commercial power (or another power) and controlling the cooling means 11 to maintain the temperature in the storing unit at a preset temperature (freezing temperature or refrigerating temperature). Here, like a general refrigerator or freezer, the storing unit includes the storing space storing the stored object and the storing unit door opening and closing the storing space such that a user can put the stored object into the storing unit and take the stored object out of the storing unit.

The cooling means 11 is divided into indirect-cooling type and direct-cooling type according to methods for cooling the storing space.

The indirect-cooling type cooling means includes a compressor compressing the refrigerant, an evaporator producing the cool air to cool a storing space or a stored object, a fan producing the forcible flow of the produced cool air, an inlet duct introducing the cool air into the storing space, and a discharge duct inducing the cool air passing through the storing space to the evaporator. In addition, the indirect-cooling type cooling cycle may include a condenser, a dryer, an expansion device, etc.

The direct-cooling type cooling means includes a compressor compressing the refrigerant, and an evaporator installed in a case defining a storing space to be adjacent to an inner surface of the case and evaporating the refrigerant. Here, the direct-cooling type cooling cycle includes a condenser, an expansion valve, etc.

The sensing unit 12 may include a door sensing unit sensing the opening and closing of the storing unit door and may be formed of a kind of switch compressed by the closing of the storing unit door and restored by the opening thereof. Moreover, the sensing unit 12 may include a temperature sensing unit sensing the temperature in the storing unit. The main control unit 13 controls the cooling means 11 to perform the cooling operation according to the sensed temperature from the sensing unit 12, etc., and thus maintains a preset temperature in the storing unit. The main control unit 13 includes a memory (not shown) storing necessary data. Here, the preset temperature includes a refrigerating temperature (e.g., 1° C. to 6° C., etc.) for a refrigerating function, a freezing temperature (e.g., −10° C. to −20° C.), or a special freezing temperature (e.g., below −25° C.).

The main control unit 13 includes a power unit (not shown) receiving commercial power (e.g., 220 V, 100 V, 230 V, etc.) and rectifying, smoothing and transforming the commercial power into using power (e.g., 5 V, 12 V, etc.) necessary for the main body apparatus 10 and the non-freezing apparatus 20. The power unit may be included in the main control unit 13 or provided in the main body apparatus 10 as a separate element. The main control unit 13 is connected to the non-freezing apparatus 20 by a power line PL to supply the necessary using power to the non-freezing apparatus 20. The main control unit 13 may be connected to the non-freezing apparatus 20 by a data line DL. The main control unit 13 may receive data (e.g., a current operation state of the non-freezing apparatus 20) from the non-freezing apparatus 20 through the data line DL. The data line DL may be selectively provided. Additionally, the main control unit 13 may transmit a control command to the non-freezing apparatus 20 through the data line DL to directly control the same.

The power line PL and the data line DL may be attached and detached to/from a connection portion 29 of the non-freezing apparatus 20 through a kind of socket-type connection portion 14.

The main body apparatus 10 may include an input unit (not shown) receiving the input of a setting command from the user, and a display unit (not shown) displaying the temperature of the storing unit, etc.

The input unit, which receives the input of temperature setting of the storing unit, an operation command of the non-freezing apparatus 20, function setting of a dispenser, and so on from the user, may be provided as, e.g., push buttons, a keyboard or a touch pad. For example, the operation command of the non-freezing apparatus 20 may be a rapid cooling command, a supercooling command, a slush command, etc.

The display unit may display an operation basically performed by the refrigerator, e.g. the temperature of the storing unit, the cooling temperature, the operation state of the non-freezing apparatus 20, etc. The display unit may be implemented as an LCD display or an LED display.

The main control unit 13 may control the temperature in the storing unit according to the temperature setting from the input unit or the prestored temperature setting and maintain the temperature in the storing unit at a temperature below at least the maximum ice crystal formation zone so that the control operation such as the supercooling control and the cooling control of the non-freezing apparatus 20 can be independently performed.

The non-freezing apparatus 20 includes a storage room with a storing space therein to store a container containing a liquid to be supercooled, the storage room being mounted and cooled in the storing unit.

The non-freezing apparatus 20 includes an input unit 21 receiving the input from the user, a display unit 22 displaying a state of the storing space or the stored object or an operation state of the non-freezing apparatus 20, a temperature sensing unit 23 sensing the temperature of the storing space or the stored object, a heat source supply unit 24 supplying heat to the storing space or generating heat in the storing space, a fan driving unit 25 operating a fan to circulate the air in the storing space by a forcible convection, an opening/closing means 26 introducing the cool air or the air from the storing unit to the storing space, a sensing unit 27 sensing the opening and closing of a storing space door opening and closing the storing space of the storage room, and a sub-control unit 28 controlling the heat source supply unit 24 which is a temperature control means based on the sensed temperature from the temperature sensing unit 23 so that the stored object in the storage room can be stored in a state at least desired by the user. The storage room includes a boundary portion separating upper and lower portions of a container to prevent or limit the air or heat exchange therebetween. The boundary portion is located between an upper space and a lower space in the storing space and has a hole through which at least a portion of the container can pass.

The non-freezing apparatus 20 is operated by using power applied from the main control unit 13. A wiring for power supply (a wiring connected to the power line PL) is connected to the connection portion 14 of the main control unit 13 through the connection portion 29 and supplied with power.

The input unit 21, which enables the user to select an on/off switch function of the non-freezing apparatus 20 and a supercooling control command, a supercooling release command or a slush keeping command, may be provided as, e.g., push buttons, a keyboard or a touch pad.

The display unit 22, which displays an on/off state of the non-freezing apparatus 20 and a control (e.g., supercooling control, etc.) currently performed by the non-freezing apparatus 20, may be provided as an LCD display, an LED display, or the like.

Moreover, the temperature sensing unit 23, which senses the temperature of the storing space or the temperature of the stored object, corresponds to a sensor formed on a sidewall of the storing space to sense the temperature of the air in the storing space or provided in proximity or contact with the stored object to accurately sense the temperature of the stored object. The temperature sensing unit 23 may apply a change value of a current value, a voltage value or a resistance value corresponding to the temperature to the sub-control unit 28. The temperature sensing unit 23 senses a sudden rise in the temperature of the stored object or the storing space during the phase transition of the stored object and enables the sub-control unit 28 to recognize the release of the supercooled state of the stored object.

In this embodiment, the temperature sensing unit 23 may be composed of an upper sensing unit (e.g., the one corresponding to the temperature sensor C1 of FIG. 3) formed in the upper side of the storage room which is the upper space of the storing space, and a lower sensing unit (e.g., the one corresponding to the temperature sensor C2 of FIG. 3) formed in the lower side of the storage room which is the lower space of the storing space.

The heat source supply unit 24 corresponds to a temperature control means controlling the temperature in the storing space to be changed to or maintained at a temperature corresponding to the supercooled state control, the slush keeping control, the supercooling release control, etc. The heat source supply unit 24 applies energy to the storing space. For example, the heat source supply unit 24 may produce thermal energy, electric or magnetic energy, ultrasonic energy, light energy, microwave energy, etc. and apply the energy to the storing space. In addition, the heat source supply unit 24 may be a thermoelectric element mounted on the upper and lower portions of the storing space, respectively, or attached to the boundary film.

Moreover, when the stored object is frozen, the heat source supply unit 24 may supply energy to thaw the stored object.

The heat source supply unit 24 is composed of a plurality of sub-heat source supply units and mounted on the upper or lower portion or the side surface of the storing space to supply energy to the storing space. In this embodiment, the heat source supply unit 24 includes an upper heat source supply unit (e.g., the one corresponding to the heat generation coil H1 of FIG. 3) formed in the upper space of the storage room which is the upper side of the storing space, and a lower heat source supply unit (e.g., the one corresponding to the heat generation coil H2 of FIG. 3) formed in the lower space of the storage room which is the lower side of the storing space. The upper heat source supply unit and the lower heat source supply unit may be independently or integrally controlled by the sub-control unit 28.

The upper sensing unit and the lower sensing unit of the temperature sensing unit 23 are mounted on or adjacent to the surfaces with the upper heat source supply unit and the lower heat source supply unit thereon.

The fan driving unit 25 is an element driving the fan element Fr formed in the lower space of the storing space in the storage room. The driving of the fan element Fr makes the temperature distribution in the lower space of the storing space uniform. Due to the uniform temperature distribution, the stored object can be maintained in a stable state during the temperature maintenance, the temperature drop or the temperature rise.

The opening/closing means 26, which introduces the air or the cool air from the storing unit to the storing space, corresponds to, e.g., a damper. When the opening/closing means 26 is opened, more air or cool air can be introduced, which facilitates rapid cooling. On the contrary, when the opening/closing means 26 is closed, the inflow of the air from the storing unit to the storage room is minimized, which facilitates the temperature rise and the temperature maintenance.

The sensing unit 27 is a component sensing the opening and closing of the storing space door opening and closing the storing space of the storage room. Like the sensing unit 12, the sensing unit 27 may be a switch turned on/off by the opening and closing of the storing space door. In addition to the switch, the sub-control unit 28 may determine the opening and closing of the storing space door according to the sensed temperature from the temperature sensing unit 23. For example, if the storing space door is opened, a large temperature change such as a sudden rise in the temperature sensed by the temperature sensing unit 23 occurs due to the influence of the external temperature. Based on this temperature change, the sub-control unit 28 can determine that the storing space door has been opened. Afterwards, if the storing space door is closed, the sensed temperature will be slowly lowered. Based on this temperature drop, the sub-control unit 28 can determine that the storing space door has been closed.

The sub-control unit 28 controls the heat source supply unit 24 according to the sensed temperature from the temperature sensing unit 23 to perform a necessary operation.

Particularly, the sub-control unit 28 may control the upper heat source supply unit according to the sensed temperature from the upper temperature sensing unit and the lower heat source supply unit according to the sensed temperature from the lower temperature sensing unit, respectively.

As described above, the sub-control unit 28 may control the heat source supply unit 24 according to the sensed temperature from the temperature sensing unit 23, thereby independently performing the control with respect to the main control unit 13. For this independent control, the sub-control unit 28 may include a memory unit storing a control algorithm, etc.

The non-freezing apparatus 20 may further include a reception sensing unit checking that the container containing the liquid to be supercooled has been stored in the storing space. The reception sensing unit may be a weight sensor provided on a bottom surface of the storing space. As the bottom surface is lifted or lowered by the weight of the stored container, the sensor can sense such lifting and lowering. Additionally, the reception sensing unit may be composed of a light-emitting portion and a light-receiving portion formed on both sides of the storing space. When the light emitted by the light-emitting portion reaches the light-receiving portion, it can be determined that the container has not been stored. When the emitted light does not reach the light-receiving portion, it can be determined that the container has been stored or received.

The reception sensing unit applies the sensing result to the sub-control unit 28, and the sub-control unit 28 cooperates with the sensing operation of the reception sensing unit. Particularly, the sub-control unit 28 can perform the supercooled state control only when the container has been stored.

In addition, when the input unit 21 acquires the reception input of the stored object from the user, the sub-control unit 28 can determine the reception of the stored object. That is, when the input unit 21 acquires a reception input command of the stored object or a withdrawal input command of the stored object, the sub-control unit 28 may perform the control according to this command.

Figure 6:
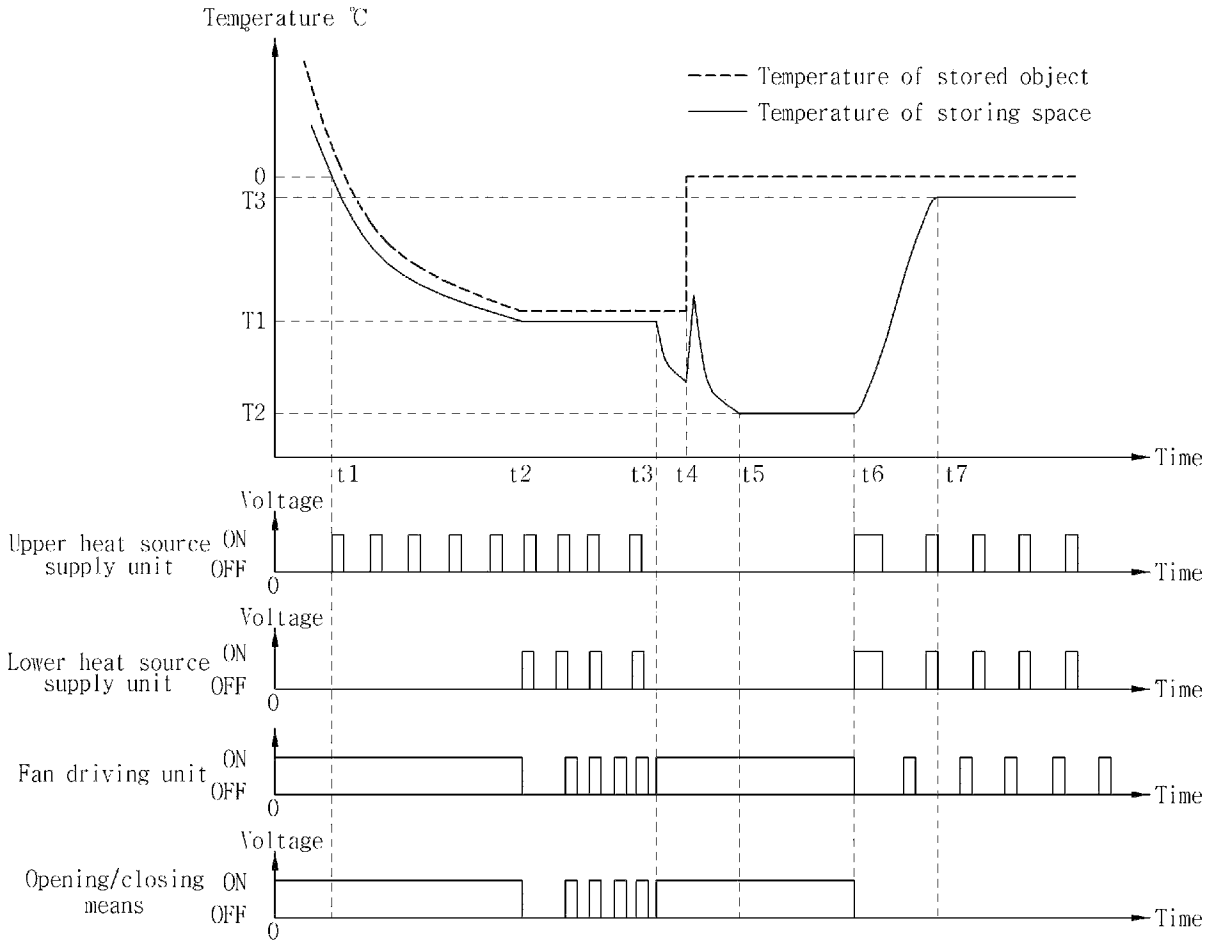
FIG. 6 is a temperature graph and an operation state view of processes performed by the non-freezing apparatus according to the present invention.

FIG. 6 illustrates a first embodiment of a temperature graph and an operation state view of processes performed by the refrigerator including the non-freezing apparatus 20 according to the present invention. In this embodiment, the temperature in the storing unit of the refrigerator is maintained at, e.g., −17° C.

The non-freezing apparatus 20 performs different processes according to the current temperature of the storing space (upper space or lower space) and the maintenance temperature or the maintenance state of the stored object. Hereinafter, the processes which can be performed by the non-freezing apparatus 20 will be described.

First, it is assumed that the current temperature is over the phase transition temperature (or a preset temperature-control start temperature region). The preset temperature-control start temperature region may be set as, e.g., 0° C. to 3° C. In the current temperature, a process of rapid cooling is performed. That is, the necessary control is to rapidly cool the upper and lower spaces of the storing space. The sub-control unit 28 maintains the heat source supply unit 24 (upper and lower) in the off state and the opening/closing means 26 in the on state (open state) such that the cool air of the storing unit can be rapidly introduced into the lower space, and controls the fan driving unit 25 to operate the fan element such that the introduced cool air can be circulated by a forcible convection, thereby rapidly lowering the temperature of the upper space and the lower space. In this process, preferably, the on state of the opening/closing means 26 and the on state of the fan driving unit 25 are maintained for at least a given time. In this embodiment, the process of rapid cooling corresponds to a time 0 to t1 section.

In addition, a process of maintaining the preset temperature-control start temperature region can be performed following the process of rapid cooling. In the process of maintaining the preset temperature-control start temperature region, since the temperature of the storing unit is relatively low, the heat source supply unit 24 is operated to maintain the temperature of the storing space. Particularly, when the upper heat source supply unit and the lower heat source supply unit are operated together, the upper space and the lower space maintain this temperature region. In this maintaining process, the opening/closing means 26 is closed. Moreover, preferably, the fan driving unit 25 is maintained in the off state.

A process of entering a supercooling temperature region T1 may be performed continuously to the process of rapid cooling. The entering process may be discontinuously performed with respect to the process of rapid cooling. For example, the entering process may be performed after the process of maintaining the preset temperature-control start temperature region is performed for a given time or according to a supercooling maintenance command of the user.

In this entering process, since the temperature of the lower space starts to be lowered to a temperature below the phase transition temperature, the upper heat source supply unit is operated in the on state intermittently, discontinuously, or using low power such that the temperature of the upper space (i.e., the air over the stored object) can be maintained at a temperature (e.g., 5° C.) higher than the phase transition temperature. Here, the lower heat source supply unit is maintained in the off state such that the temperature of the stored object can be lowered to a desired supercooling temperature region. Here, the opening/closing means 26 is switched to the on state (open state) such that the cool air of the storing unit can be rapidly introduced into the lower space, and the fan element is switched to the on state by the fan driving unit 25 such that the introduced cool air can be circulated by a forcible convection, thereby rapidly lowering the temperature of the upper space and the lower space. This entering process is performed in a time t1~t2 section to enter the supercooling temperature region T1 below the phase transition temperature.

When the temperature of the lower space reaches the supercooling temperature region T1 (e.g., −7° C. to −8° C.), a process of maintaining the supercooling temperature region T1 is performed continuously to the entering process. For the maintaining process, the upper heat source supply unit is repeatedly turned on/off or uses given power to maintain the temperature, and the lower heat source supply unit is repeatedly turned on/off or uses given power to maintain the temperature of the lower space in the supercooling temperature region T1. Here, the sub-control unit 28 controls the on/off of the opening/closing means 26 and the fan driving unit 25 according to the temperature of the lower space such that the temperature of the lower space can be maintained in the supercooling temperature region T1. The stored object stored in the storing space can be maintained in the supercooled state, i.e., the non-frozen state by the process of maintaining the supercooling temperature region T1. This maintaining process can be performed for a time desired by the user or a preset time. In this embodiment, for the convenience of the explanation, the maintaining process is performed in a time t2~t3 section.

A process of lowering the temperature may be performed continuously or independently with respect to the process of maintaining the supercooling temperature region T1 or according to the user's command. In a time t3, the sub-control unit 28 controls the heat source supply unit 24 in the off state and the opening/closing means 26 and the fan driving unit 25 in the on state to rapidly lower the temperature of the storing space. As a result, it makes the temperature of the stored object rapidly lowered. In a time t4, the supercooled state of the stored object is released and the temperature of the stored object is suddenly raised due to the temperature drop such that the phase transition may occur. Alternatively, the process of lowering the temperature may be performed after the supercooling is released by a supercooling release operation of a separate means (e.g., electric shock, vibration shock, etc.) which can release the supercooled state of the stored object. The release of the supercooling may be determined based on the phenomenon that the temperature of the storing space is raised due to the temperature rise of the stored object.

The process of lowering the temperature is performed until the temperature of the lower space reaches and maintains, e.g., a temperature T2 (a cooling temperature of the storing unit). In this embodiment, this process is performed in a time t3~t6 section. That is, when the temperature of the lower space reaches the temperature T2 in a time t5, the temperature is not lowered but maintained. More slush can be produced in the stored object during the phase transition by the process of lowering the temperature. As the time for performing the process of lowering the temperature is associated with an amount of slush to be produced, this process may be performed for a preset time or a time decided by a separate input (an input time or a slush amount) of the user.

After the process of lowering the temperature, a process of raising the temperature is performed in a time t6. The sub-control unit 28 switches the fan driving unit 25 and the opening/closing means 26 into the off state and controls the heat source supply unit 24 (upper heat source supply unit and lower heat source supply unit) in the on state. Accordingly, the temperature of the lower space (and the upper space) is raised. The process of raising the temperature maintains the temperature of the lower space at a slush keeping temperature T3 after a time t7 when the temperature of the lower space reaches the slush keeping temperature T3. In the early stage of the process of raising the temperature, the heat source supply unit 24 is on for a relatively-long time or uses high power to rapidly raise the temperature. Afterwards, the heat source supply unit 24 is intermittently on/off or uses low power to maintain the temperature. Moreover, after the early stage, the fan driving unit 25 is also intermittently on/off such that the temperature distribution of the lower space can be uniform. The crystallization size is decided according to the degree of the slush keeping temperature T3. That is, if the slush keeping temperature T3 is low, the crystal size of the slush produced is relatively large, and if the slush keeping temperature T3 is high, the crystal size of the slush produced is relatively small. The slush keeping temperature T3 may be maintained at a temperature below the phase transition temperature to prevent the slush from being changed to liquid.

As described above, the upper heat source supply unit is on/off-controlled so that the temperature of the upper space can exceed the temperature-control start temperature region expect the temperature drop section. However, in the process of keeping the slush, the upper heat source supply unit may be on/off-operated to maintain the temperature of the upper space at the slush keeping temperature T3.

The embodiment of FIG. 6 may be a case where the temperature control apparatus (or the non-freezing apparatus) is initially installed in the storing unit performing the cooling. In another case, the temperature control apparatus has been installed in the storing unit of the refrigerator performing the cooling, but has not been operated without receiving the input of an operation command, etc. Here, the temperature of the storing space in the temperature control apparatus is substantially identical to the temperature of the storing unit. The temperature control apparatus can start the temperature control when the user puts the stored object into the storing space or inputs the operation command. In this situation, as the temperature of the storing space is significantly low, the phase transition of the stored object may occur during the cooling. Therefore, the heat source supply unit 24 (upper heat source supply unit and lower heat source supply unit) is controlled to operate in the early stage so that the temperature of the storing space can enter the supercooling temperature region. In this entering process, both the fan driving unit 25 and the opening/closing means 26 are maintained in the off state or only the opening/closing means 26 is maintained in the off state such that the temperature of the upper space of the storing space exceeds the temperature-control start temperature region and the temperature of the lower space enters the supercooling temperature region. After the temperature of the lower space enters the supercooling temperature region, the heat source supply unit 24, the fan driving unit 25 and the opening/closing means 26 are controlled as in the processes succeeding the process of maintaining the supercooling temperature region of FIG. 6.

During the cooling processes, while the stored object is maintained in the supercooled state or cooled to a temperature below the phase transition temperature, the freezing can be sensed and determined. The sub-control unit 28 and the sensing unit 27 can determine the release of the supercooled state by sensing the temperature change that the temperature of the stored object is suddenly raised from, e.g., −4° C. When the supercooled state is released, the heat source supply unit 24 (upper heat source supply unit and lower heat source supply unit) is operated to perform the thawing. Upon the completion of the thawing, the cooling is restarted. Preferably, the opening/closing means 26 is closed during the thawing process. The fan driving unit 25 may be intermittently on/off-controlled to achieve the uniform temperature.

The sub-control unit 28 may intercept the power supply to the respective elements according to the on/off switch input of the non-freezing apparatus from the input unit 21, thereby preventing their operation.

The input unit 21 further has a function of acquiring a thawing command. The sub-control unit 28 operates the heat source supply unit 24 to apply energy (particularly, heat energy) to thaw the stored object according to the thawing command from the input unit 21.

Figure 7:
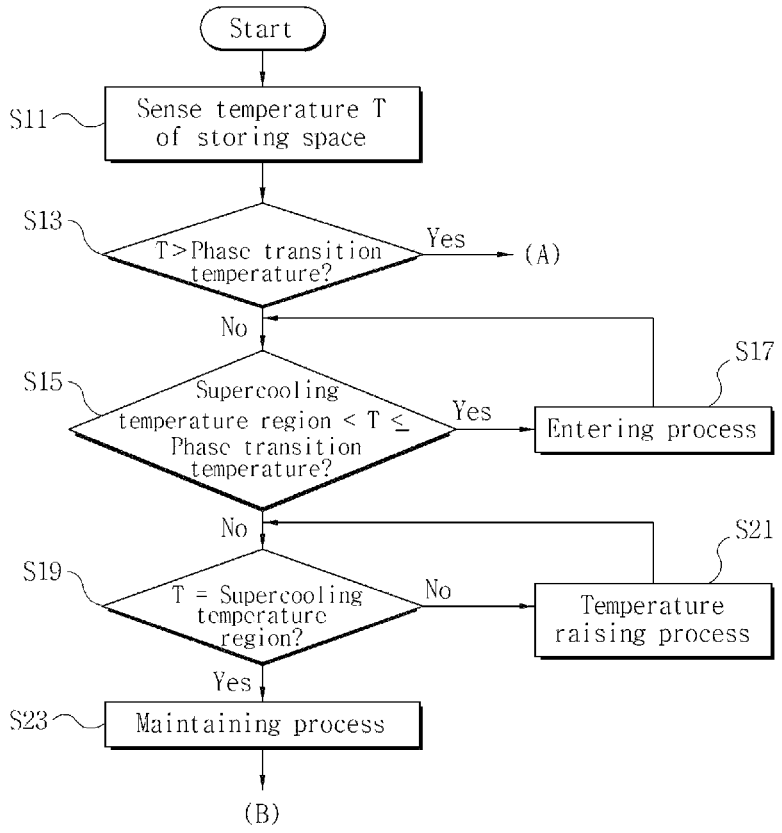
FIGS. 7 to 9 are flowcharts showing the processes performed by the non-freezing apparatus according to the present invention.
Figure 8:
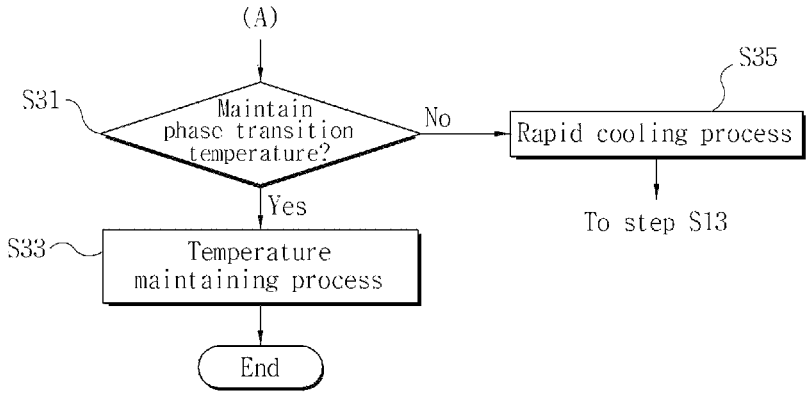
Figure 9:
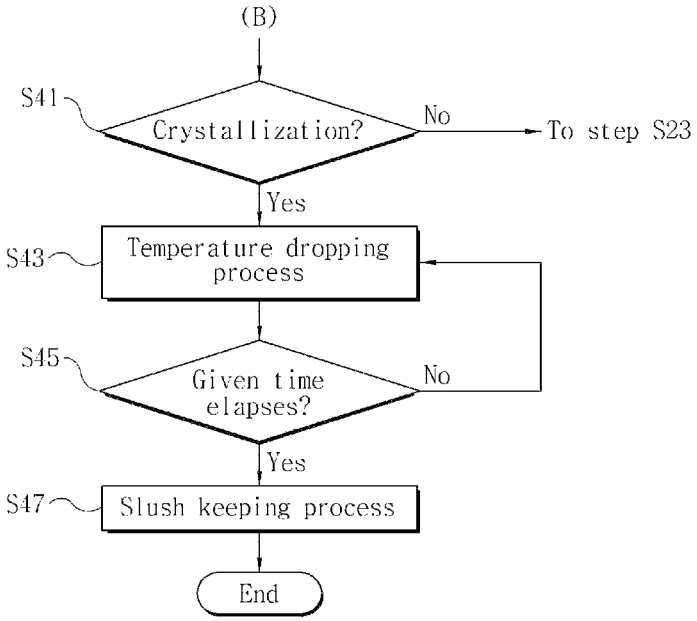

FIGS. 7 to 9 are flowcharts showing the processes performed by the non-freezing apparatus according to the present invention. These processes can be started when the input unit 21 acquires the operation command for the temperature control apparatus (or the non-freezing apparatus). The user or the sub-control unit 28 may set a target process as the process of maintaining the phase transition temperature, the process of maintaining the supercooling temperature, the process of keeping the slush, etc.

At step S11, the sub-control unit 28 senses a current temperature T of the storing space (upper space or lower space) according to the sensed value from the temperature sensing unit 23.

At step S13, the sub-control unit 28 determines whether the current temperature T is higher than the phase transition temperature or the preset temperature-control start temperature region. If the current temperature T is higher than the phase transition temperature, the sub-control unit 28 goes to process (A). If the current temperature T is equal to or lower than the phase transition temperature, the sub-control unit 28 goes to step S15.

In process (A), as illustrated in FIG. 8, at step S31, the sub-control unit 28 determines whether the current preset process or target process is the process of maintaining the phase transition temperature (the preset temperature-control start temperature region). If so, the sub-control unit 28 goes to step S33, and if not, the sub-control unit 28 goes to step S35.

At step S33, the sub-control unit 28 performs the process of maintaining the temperature through the on state and the on/off control of the opening/closing means 26 and the fan driving unit 25 so that the temperature of the storing space can be close to the phase transition temperature. The sub-control unit 28 controls the temperature of the upper space and the lower space to be almost uniform, and turns on/off the heat source supply unit 24 (upper heat source supply unit and lower heat source supply unit) to maintain the temperature over the phase transition temperature.

At step S35, the sub-control unit 28 switches the opening/closing means 26 into the on state to introduce the cool air into the lower space and controls the fan driving unit 25 in the on state to perform the process of rapid cooling which can rapidly cool the upper space and the lower space. Next, the sub-control unit 28 goes to step S13. The steps S13, S31 and S35 are repeatedly performed according to the current temperature.

At step S15, the sub-control unit 28 determines whether the current temperature T of the lower space is higher than the supercooling temperature and equal to or lower than the phase transition temperature. If the temperature T belongs to this range, the sub-control unit 28 goes to step S17, and if not, the sub-control unit 28 goes to step S19.

At step S17, so as to perform the process of entering the supercooling temperature region, the sub-control unit 28 operates the upper heat source supply unit such that the temperature of the upper space is maintained low but higher than the phase transition temperature, controls the opening/closing means 26 in the on state to continuously cool the lower space, and controls the fan driving unit 25 to operate the fan element to uniformly cool the lower space by a forcible convection. The steps S15 and S17 are repeatedly conducted to perform the cooling.

At step S19, the sub-control unit 28 determines whether the current temperature T is substantially maintained in the supercooling temperature region. If the temperature T is maintained in the supercooling temperature region, the sub-control unit 28 goes to step S23, and if the temperature T is lower than the supercooling temperature region, the sub-control unit 28 goes to step S21.

At step S21, since the current temperature T is lower than the supercooling temperature region, the sub-control unit 28 controls the heat source supply unit 24 to raise the temperature of the storing space. Here, both the fan driving unit 25 and the opening/closing means 26 are maintained in the off state, or only the opening/closing means 26 is maintained in the off state.

The sub-control unit 28 can make the conditions for entering the process of maintaining the storing space or the stored object in the supercooled state by the steps S19 and S21.

At step S23, the sub-control unit 28 performs the process of maintaining the supercooled state. At step S23, the sub-control unit 28 goes to process (B).

At step S41 of FIG. 9, when the slush keeping command has been input or is input through the input unit 21, or when the stored object stored in the supercooled state is naturally released from the supercooled state, the sub-control unit 28 goes to step S43. If not, the sub-control unit 28 goes to step S23 to perform the process of maintaining the supercooled state.

*138 At step S43, the sub-control unit 28 turns off the heat source supply unit 24 and performs the process of lowering the temperature through the on state of the fan driving unit 25 and the open state of the opening/closing means 26. While performing the process of lowering the temperature, the sub-control unit 28 may lower and maintain the temperature at a preset temperature region or a temperature region decided by the user's input.

At step S45, the sub-control unit 28 determines whether the temperature has been maintained at the preset temperature or the cooling temperature of the storing unit for a given time during the process of lowering the temperature. If so, the sub-control unit 28 goes to step S47.

At step S47, to perform the process of keeping the slush, the sub-control unit 28 controls the heat source supply unit 24 in the on state or with high power to suddenly raise the temperature. The fan driving unit 25 and the opening/closing means 26 maintain the off state during the sudden rise. In the process of keeping the slush, the sub-control unit 28 controls the heat source supply unit 24 and the fan driving unit 25 to maintain the slush keeping temperature, thereby maintaining the lower space and the upper space at a given temperature.

The process of determining the supercooled state of the stored object is as follows. When determining the supercooled state of the liquid, the sub-control unit 28 compares the upper sensed temperature TU or the lower sensed temperature TL (overall, T) sensed by the upper sensing unit or the lower sensing unit with the supercooled state temperature T1. Preferably, the sub-control unit 28 compares the lower sensed temperature TL almost equivalent to the temperature of the stored object with the supercooled state temperature T1. Here, the supercooled state temperature T1 is, e.g., −6° C. If the sensed temperature is equal to or lower than the supercooled state temperature T1, the sub-control unit 28 determines whether this temperature state has been maintained for a preset given time td. The given time td corresponds to a reference time when it can be determined that the stored object enters and maintains the supercooled state from the time point when the sensed temperature T is equal to or lower than the supercooled state temperature T1. The sub-control unit 28 determines that the stored object or the storing space is maintained in the supercooled state. If the sensed temperature is higher than the supercooled state temperature T1 or the elapsed time does not reach the given time td, the sub-control unit 28 determines the current state as the cooled state.

The sub-control unit 28 may determine the state (supercooled state or cooled state) of the liquid which is the stored object with the proceeding of the cooling of the stored object or the storing space by the process of determining the state of the stored object described above and display the state on the display unit 22. The sub-control unit 28 continuously or intermittently performs the process of determining the state of the stored object. For example, the sub-control unit 28 may control the display unit 22 to display the cooled state of the stored object with red color and the supercooled state thereof with green color. That is, the sub-control unit 28 can provide the current state (supercooled state or cooled state) of the stored object to the user, etc.

In addition, the sub-control unit 28 may check the opening and closing of the storing space door through the sensing unit 27 or receive the opening and closing information of the storing unit door from the main body apparatus 10. When the storing unit door is opened, the noise caused by the driving of the fan element in the non-freezing apparatus 20 may be significantly transferred to the outside. Thus, the sub-control unit 28 controls the fan driving unit 25 to stop the driving of the fan element. Alternatively, when the storing space door is opened, since the air circulation in the storing space is not necessary, the sub-control unit 28 controls the fan driving unit 25 to stop the driving of the fan element.

Moreover, when the storing unit door is opened, the sub-control unit 28 activates the display unit 22 to display the current process such as the supercooled state or the cooled state of the liquid which is the stored object. However, the sub-control unit 28 may activate the display unit 22 only when the storing unit door or the storing space door is opened, and thus the user can see this state information.

Figure 10:
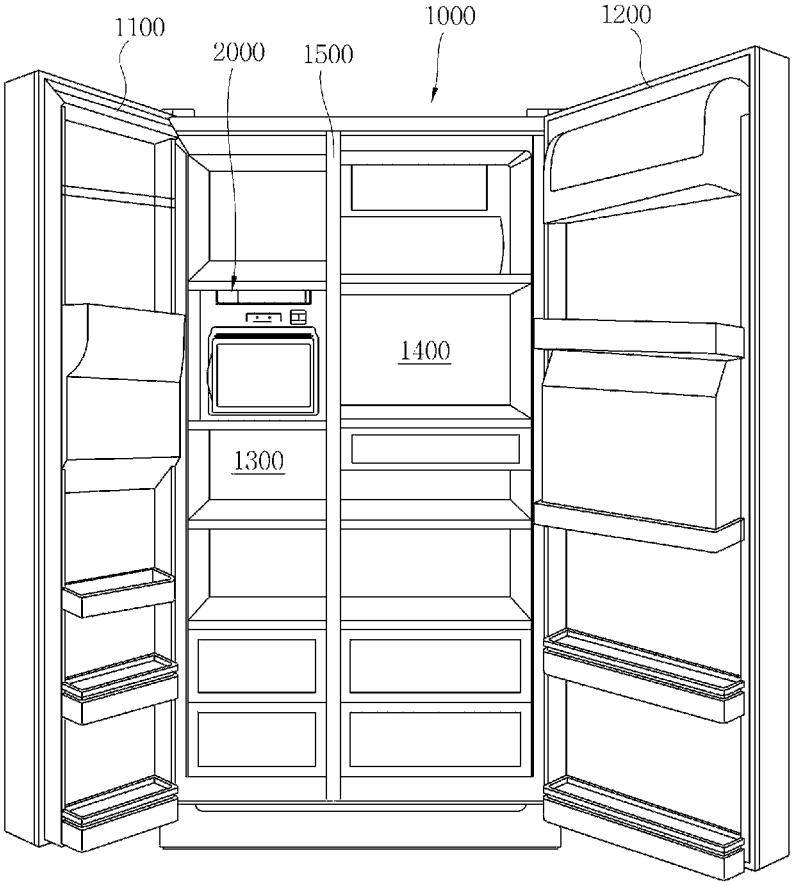
FIG. 10 is a view of a refrigerator according to a first embodiment of the present invention.

FIG. 10 is a view of a refrigerator according to a first embodiment of the present invention. The refrigerator 1000 is an apparatus supplying the cool air into a cooling space 1300 and 1400 using a cooling cycle. FIG. 10 illustrates a state where a non-freezing apparatus 2000 is installed in a freezing chamber 1300 of a side-by-side refrigerator which is an example of the refrigerator 1000. The cooling space 1300 and 1400 in the refrigerator 1000 is divided into the freezing chamber 1300 and a refrigerating chamber 1400 by a bulkhead 1500. Support portions (not shown) are formed on both sides surfaces of the freezing chamber 1300 to protrude therefrom, and hook-shaped ribs 2200 supported by the support portions (not shown) and fixing the non-freezing apparatus 2000 are formed on both side surfaces of the non-freezing apparatus 2000. The non-freezing apparatus 2000 is fixed in the freezing chamber 1300 by the hook-shaped ribs 2200 and the support portions (not shown) and may be detachable from the freezing chamber 1300 like other general shelves. The non-freezing apparatus 2000 needs power supply. Preferably, power connectors (not shown) are provided between the refrigerator 1000 and the non-freezing apparatus 2000 and connected to each other to supply power. The power connectors (not shown) may be contact-type connectors such as battery chargers formed in the corresponding positions of the refrigerator 1000 and the non-freezing apparatus 2000 and transferring power through the contact, or a pair of female and male port-type connectors engaged with ends of power transfer cables provided in the refrigerator 1000 and the non-freezing apparatus 2000, respectively. Additionally, the non-freezing apparatus 2000 may be fixed to the freezing chamber 1300 using screws or the like not to be detached therefrom. In this situation, not a separate power connector (not shown) but a general electric wire is provided between the non-freezing apparatus 2000 and the freezing chamber 1300 to supply power from the refrigerator 1000 to the non-freezing apparatus 2000. Meanwhile, when it is intended to display a working state, a supercooling proceeding state and so on of the non-freezing apparatus 2000 through an external display (not shown) installed on the outside of the refrigerator 1000, it is preferable to form the power connector (not shown) or the electric wire to transmit electricity in two ways so as to transfer information from a PCB (not shown) which is a control unit controlling the operation of the non-freezing apparatus 2000 to the external display (not shown) or a control unit (not shown) of the refrigerator 1000.

Figure 11:
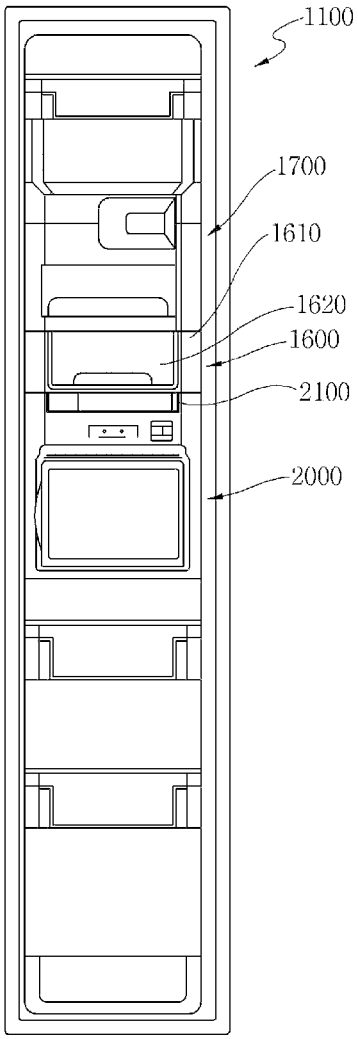
FIG. 11 is a view of a refrigerator according to a second embodiment of the present invention.

FIG. 11 is a view of a door provided in a refrigerator according to a second embodiment of the present invention. In the refrigerator according to the second embodiment of the present invention, a non-freezing apparatus 2000 is installed in a freezing chamber door 1100 of the refrigerator. The freezing chamber door 1100 serves to open and close a freezing chamber 1300. The non-freezing apparatus 2000, an ice bank 1600 and an ice maker 1700 are installed in the freezing chamber door 1100 sequentially from the lower side. The ice maker 1700 is supplied with water to make ice. When the ice maker 1700 finishes the ice making, the ice made in the ice maker 1700 is automatically or manually supplied to the ice bank 1600. In a case where the ice is automatically supplied from the ice maker 1700 to the ice bank 1600, an ice tray (not shown) in which the ice is made is rotatably installed in the ice maker 1700 and rotated to drop the ice to the lower side upon the completion of the ice making. The ice bank 1600 includes an outer casing 1610 mounted in the freezing chamber door 1100 and a drawer 1620 which can be pulled out from the outer casing 1610. The outer casing 1610 has an opening portion on the upper side so that the ice dropped from the ice maker 1700 can be introduced therethrough. The ice made in the ice maker 1700 is dropped to the lower portion by the rotation of the ice tray (not shown), passed through the opening portion formed in the outer casing 1610 of the ice bank 1600, and stored in the drawer 1620 of the ice bank 1600. When dropped to the ice bank 1600, the ice gives a shock to the ice bank 1600. This shock may be transferred to the freezing chamber door 1100, the non-freezing apparatus 2000, etc. Accordingly, the non-freezing apparatus 2000 has a groove 2100 having a larger section than that of the drawer 1620. As such, when the ice is dropped to the drawer 1620, the drawer 1620 can be downwardly moved to reduce the shock.

Figure 12:
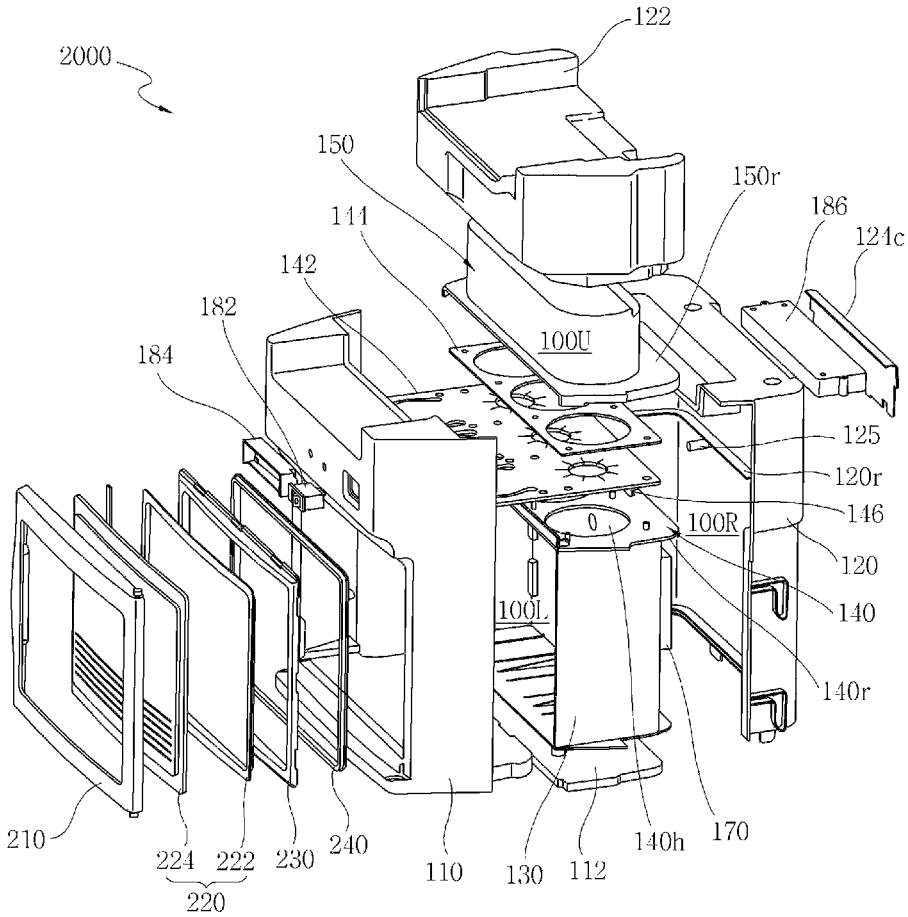
FIGS. 12 and 13 are exploded perspective views of a non-freezing apparatus according to an embodiment of the present invention.
Figure 13:
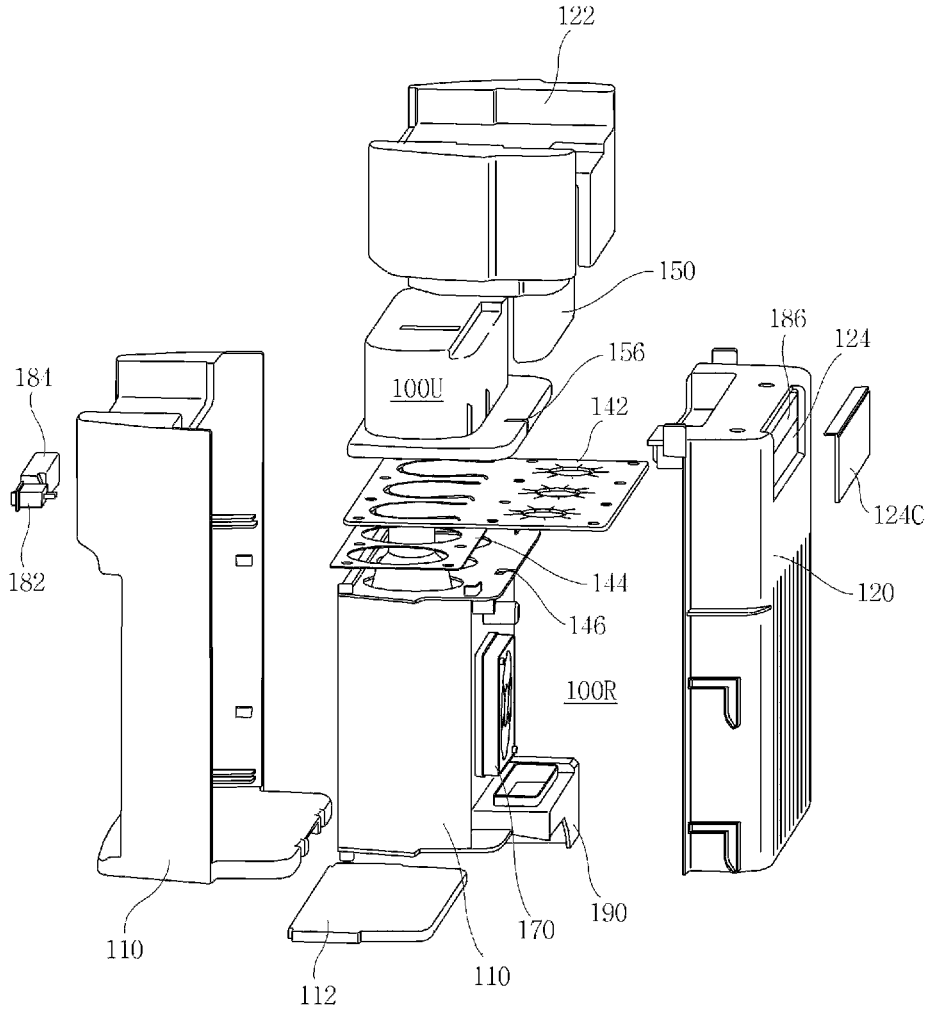

FIGS. 12 and 13 are exploded perspective views of a non-freezing apparatus according to an embodiment of the present invention.

The non-freezing apparatus 2000 according to the embodiment of the present invention includes a casing 100 defining the inner space for storing a container and a door 200 opening and closing the casing 100, and is installed in a refrigerator 1000 storing food at a temperature below 0° C. such as a freezing chamber of the refrigerator 1000. The casing 100, which separates the outer space, i.e., the space of the refrigerator 1000 in which the non-freezing apparatus 2000 is installed from the inner space of the non-freezing apparatus 2000, includes outer casings 110 and 120 forming the external appearance of the non-freezing apparatus 2000. The outer casings 110 and 120 include a front outer casing 110 and a rear outer casing 120. The front outer casing 110 forms the external appearance of the front and lower portions of the non-freezing apparatus 2000, and the rear outer casing 120 forms the external appearance of the rear and upper portions of the non-freezing apparatus 2000. The casing 100 enables upper and lower portions of container containing a liquid to be located and stored in different temperature regions. More specifically, the lower portion of the container is located in a temperature region (about −1° C. to −5° C.) of the maximum ice crystal formation zone, and the upper portion of the container is located in a higher temperature region (about −1° C. to 2° C.) in which the ice crystals are not easily formed. For this purpose, the casing 100 includes a lower space 100L having the temperature region (about −1° C. to −5° C.) of the maximum ice crystal formation zone, and an upper space 1000 having the temperature region (about −1° C. to 2° C.) in which the ice crystals are not easily formed. The upper space 1000 and the lower space 100L are separated by a bulkhead 140. The casing 100 includes a lower casing 130 defining the lower space 100L with the bulkhead 140 and an upper casing 150 defining the upper space 100U with the bulkhead 140.

A flow fan 170 is installed at the rear of the lower space 100L so that the liquid stored in the lower portion of the container located in the lower space 100L can rapidly reach the temperature region (about −1° C. to −5° C.) of the maximum ice crystal formation zone and have a supercooled state. In addition, a lower heater (not shown) is provided to adjust the temperature of the lower space 100L. An upper heater (not shown) is installed adjacent to the upper casing 150 so that the upper portion of the container located in the upper space 100U can be maintained in the temperature region (about −1° C. to 2° C.) in which the ice crystals are not easily formed. Moreover, a separation film 142 made of an elastic material is installed on the bulkhead 140 to prevent the heat exchange from occurring between the upper space 100U and the lower space 100L having different temperatures due to a forcible flow produced by the flow fan 170. Further, preferably, fixing plates 144, which can be fixed to the bulkhead 140 by screws or the like, are provided to press the separation film 142 in the up-down direction to fix the separation film 142 to the bulkhead 140.

Meanwhile, an insulation material 112 for insulating the lower space 100L from the outer space is provided at the lower portions of the outer casings 110 and 120, and an insulation material 122 for insulating the upper space 100U from the outer space is provided at the upper portions of the outer casings 110 and 120. In addition, a power switch 182, a display unit 184 and the like are installed between the front outer casing 110 and the insulation material 122, and the PCB (not shown) controlling electronic components, such as the power switch 182, the display unit 184, the upper and lower heaters (not shown), the flow fan 170 and a damper 190, and a PCB installation portion 186 are installed between the rear outer casing 120 and the insulation material 122. The rear outer casing 120 further includes an opening portion 124 through which the PCB installation portion 186 can be detached in an assembled state of the outer casings 110 and 120 for the PCB installation, and a PCB cover 124c covering the opening portion 124 after the mounting of the PCB installation portion 186.

In the meantime, a bulkhead is formed to prevent the cool air from flowing from the lower portion of the rear space 100R to the upper portion thereof and reducing the temperature of the upper space 100U. A rib 120*r* formed on the rear outer casing 120 and a rib 140*r* formed on the bulkhead 140 of the upper portion of the lower casing 130 to protrude from the lower casing 130 backwards overlap with each other, thereby forming the bulkhead. Preferably, a rib 150*r* having a shape corresponding to that of the bulkhead 140 of the upper portion of the lower casing 130 is provided at the lower portion of the upper casing 150 to protrude therefrom backwards. The rib 120*r* formed on the rear outer casing 120, the rib 140*r* formed on the bulkhead 140 and the rib 150*r* formed on the upper casing 150 overlap with each other, thus forming the bulkhead of the rear space 100R.

The door 200 is installed on the front surface of the front outer casing 110 to open and close the lower space 100L. The door 200 includes a door panel 220 made of a transparent or semitransparent material in a door casing 210, a door frame 230 fixed to the door casing 210 and fixing the door panel 220 therewith, and a gasket 240 mounted at the rear of the door frame 230 and sealing up between the door 200 and the front outer casing 110. The non-freezing apparatus 2000 according to the embodiment of the present invention includes a plurality of door panels 220. The respective door panels 220 are installed between the door casing 210 and the door frame 230 with a gap such that air layers are formed between the door panels 220. The air layers not only compensate for a low-insulation property of the door 200 but also prevent the frosting of the door 200, i.e., the door panels 220. The gasket 240 is made of an elastic material to seal up the gap between the door 100 and the front outer casing 110, thereby preventing the heat exchange from occurring between the cooling space 1300 and 1400 in which the non-freezing apparatus 2000 is mounted and the inside of the non-freezing apparatus 2000. That is, the gasket 240 can prevent leakage of the cool or hot air.

Meanwhile, a rear space R is defined by the rear outer casing 120, the lower casing 130 and the upper casing 150. The flow fan 170, the damper 190 and the lower heater (not shown) are installed in the rear space R. Particularly, the PCB installation portion 186 is installed at the upper portion of the rear space R to be detachable therefrom. The lower heater (not shown), the upper heater (not shown), the lower sensor (not shown), the upper sensor (not shown), the flow fan 170, the damper 190, the power switch 182 and the display unit 184 are connected to the PCB through an electric wire. The PCB is fixed in the PCB installation portion 186, and then the PCB installation portion 186 is fitted into a groove formed in the insulation material 122 of the upper space through the opening portion 124 formed in the rear outer casing 120. The electric wire connecting the PCB to the respective electronic components is connected to the PCB with a sufficient length to pull out the PCB installation portion 186 through the opening portion 124 of the rear outer casing 120. Accordingly, when the PCB is to be repaired or replaced, it is not necessary to separate the front outer casing 110 from the rear outer casing 120, which improves the convenience of maintenance and repair. In addition, grooves 136 and 156 are provided in the upper portion of the lower casing 130 and the lower portion of the upper casing 150, respectively, so that the electric wire connecting the PCB to the respective electronic components can be fitted thereinto. The upper portion of the lower casing 130 and the lower portion of the upper casing 150 are fixed to each other in an overlapping manner. The separation film 142 or the fixing plate 144 described above are located between the upper portion of the lower casing 130 and the lower portion of the upper casing 150. Moreover, when the PCB installation portion 186 is inserted into the insulation material 122 of the upper space in the rear outer casing 120, the opening portion 124 is closed by the PCB cover 124*c*. If the cool air of the cooling space infiltrates through the opening portion 124 during the operation, there is the possibility of lowering the temperature of the upper space 100U which should be maintained at a higher temperature than that of the lower space 100L, in addition to the cooling space. Therefore, there is a disadvantage in that a heating value of the upper heater (not shown) should be increased. When the opening portion 124 is closed by the PCB cover 124*c*, the energy efficiency can be improved and the liquid can be stably changed to the supercooled state.

Figure 14:
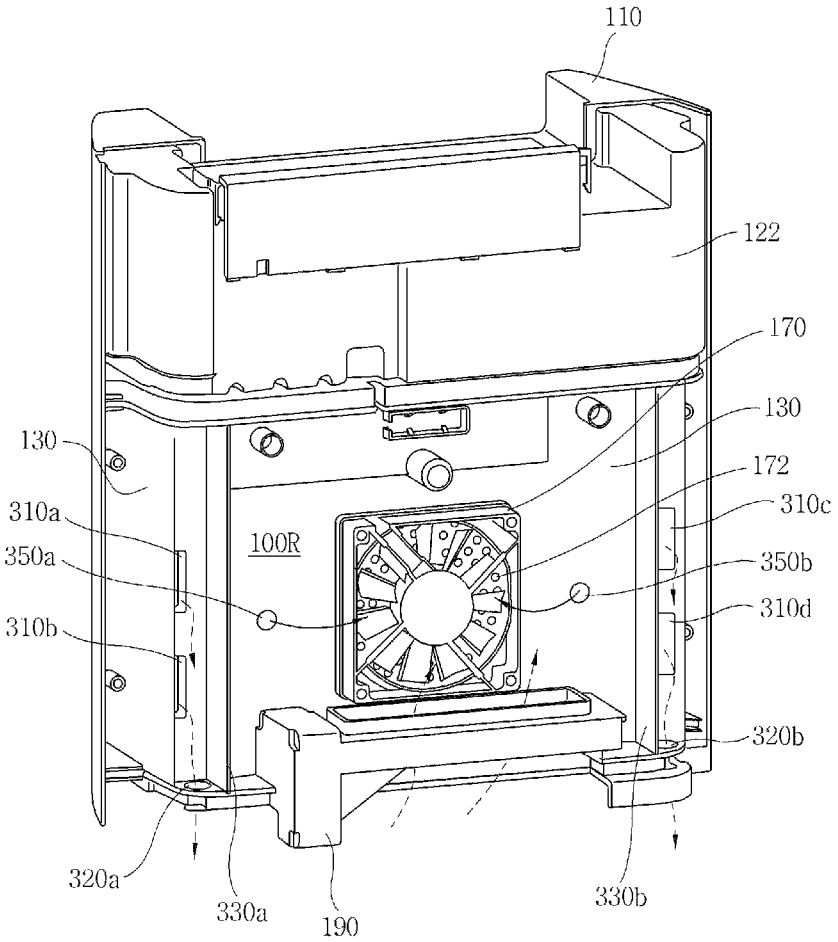
FIG. 14 is a view of a rear space of the non-freezing apparatus according to the embodiment of the present invention.
Figure 15:
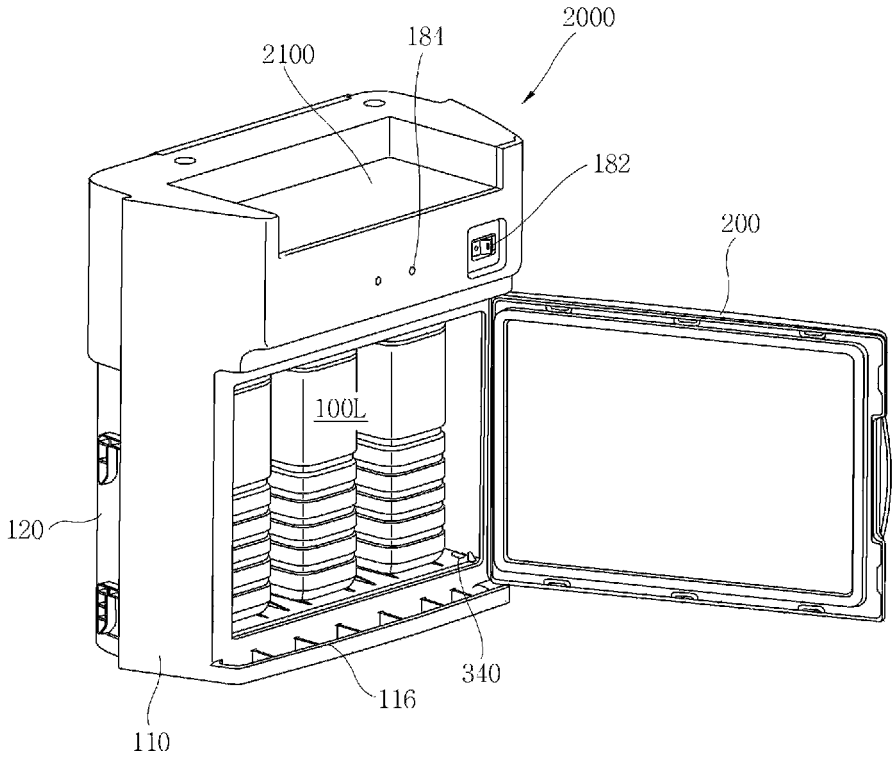
FIG. 15 is a perspective view of the non-freezing apparatus according to the embodiment of the present invention.

FIG. 14 is a view of the rear space of the non-freezing apparatus according to the embodiment of the present invention, and FIG. 15 is a perspective view of the non-freezing apparatus according to the embodiment of the present invention. As described above, the damper 190 is installed at the lower portion of the rear space 100R to control the inflow of the cool air. In addition, the flow fan 170 installed on the rear surface of the lower casing 130 produces a forcible flow such that the air introduced into the rear space 100R can be introduced into the lower space 100L and the air of the lower space 100L can be discharged again to the rear space 100R. A discharge grill 172 is provided in the installation position of the flow fan 170 in the lower casing 130 so that the flow produced by the flow fan 170 can flow therethrough, thereby forming a passage from the rear space 100R to the lower space 100L. Moreover, first discharge holes 310*a*, 310*b*, 310*c* and 310*d* are formed in the rear surface of the lower casing 130 to discharge the flow from the lower space 100L to the rear space 100R. The first discharge holes 310 are formed at both side ends. Four first discharge holes 310*a*, 310*b*, 310*c* and 310*d* are formed in twos in the up-down direction. The flow produced by the flow fan 170 is introduced into the lower space 100L through the discharge grill 172, and then discharged again through the first discharge holes 310*a*, 310*b*, 310*c* and 310*d* located at both side ends. Thus, a natural cooling passage is formed in the lower space 100L. In the meantime, second discharge holes 320 are formed in the lower portion of the lower space 100L to discharge the flow discharged through the first discharge holes 310*a*, 310*b*, 310*c* and 310*d* to the cooling space. Here, bulkheads 330*a* and 330*b* are installed between the flow fan 170 and the first discharge holes 310*a*, 310*b*, 310*c* and 310*d* to prevent the flow discharged through the first discharge holes 310*a*, 310*b*, 310*c* and 310*d* from flowing to the central portion in which the flow fan 170 is located and flowing into the lower space 100L again.

Further, some of the flow flowing into the lower space 100L through the first discharge holes 310*a*, 310*b*, 310*c* and 310*d* and cooling the liquid stored in the container is discharged directly to the cooling space through third discharge holes 340 located in the lower portion of the lower space 100L. Preferably, the third discharge holes 340 are formed in the left and right in the same number to form symmetric passages.

Accordingly, when the damper 190 is opened and the flow fan 170 is operated, the cool air is introduced from the cooling space to the rear space 100R through the damper 190, and then introduced from the rear space 100R to the lower space 100L through the discharge grill 172, thus cooling the lower portion of the container containing the liquid in the non-freezing apparatus 2000.

Some of the flow exchanging heat with the liquid contained in the container and cooling the liquid is discharged directly to the cooling space through the third discharge holes 340 located at both sides of the lower portion of the lower space 100L. The rest of the flow is discharged to the rear space 100R through the first discharge holes 310*a*, 310*b*, 310*c* and 310*d* of both side ends, and then discharged to the outside (cooling space) through the second discharge holes 320*a* and 320*b*.

Meanwhile, fourth discharge holes 350*a* and 350*b* are further formed in the lower casing 130 to be located inside the bulkheads 330*a* and 330*b*. That is, the bulkheads 330*a* and 330*b* exist between the fourth discharge holes 350*a* and 350*b*, and the first discharge holes 310*a*, 310*b*, 310*c* and 310*d* and the second discharge holes 320*a* and 320*b*. In a state where the damper 190 is closed, when the flow fan 170 is operated, the flow discharged from the rear space 100R to the lower space 100L through the discharge grill 172 is circulated in the lower space 100L and discharged again to the rear space 100R through the fourth discharge holes 350*a* and 350*b*. That is, when it is determined that the temperature of the lower space 100L reaches an appropriate temperature for storing the liquid in the supercooled state, in a state where the damper 190 is closed, the flow is circulated between the lower space 100L and the rear space 100R through the discharge grill 172 and the fourth discharge holes 350*a* and 350*b*, and the cool air is not introduced any more from the external cooling space.

Referring to FIG. 15, a trough 116 is formed at a contact portion of the door 200 and the front outer casing 110. The trough 116 prevents dews or moisture deposited on the container from being frozen on the door 200 or the front outer casing 110. Without the trough 116, the door 200 and the front outer casing 110 are not closely attached to each other but have a gap therebetween, and the cool air infiltrates into the gap and lowers the temperature of the lower space 100L. That is, since the dews deposited on the door 200 or the front outer casing 110 are dropped and collected in the trough 116, the frosting or freezing of the moisture does not occur on the bottom surface of the front outer casing 110 brought into contact with the door 200.

Figure 16:
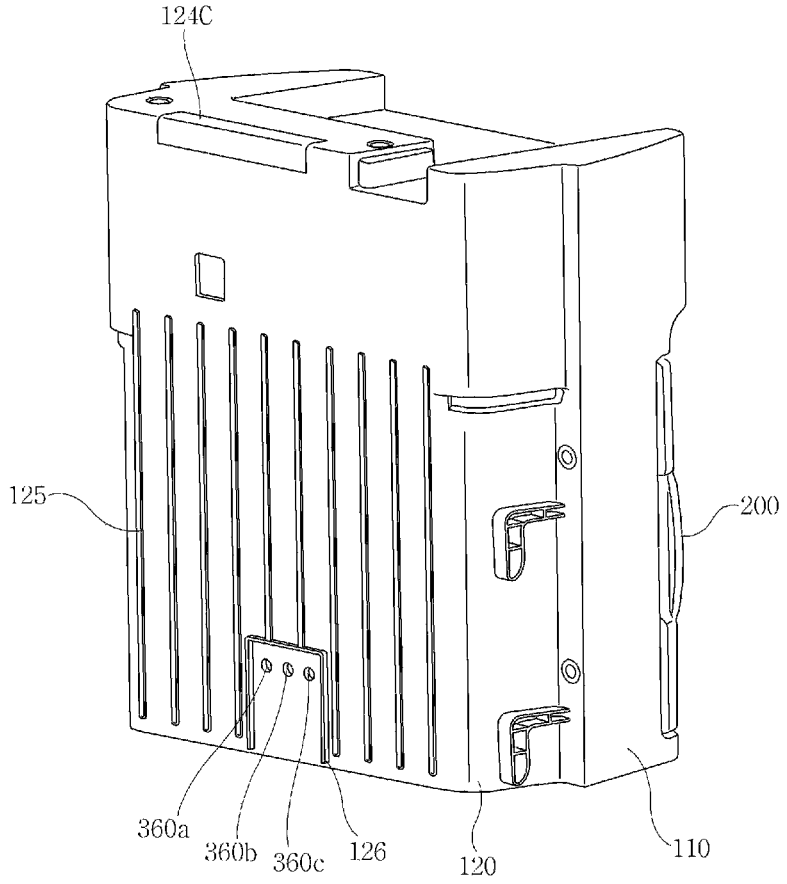
FIG. 16 is a view of the rear of the non-freezing apparatus according to the embodiment of the present invention.

FIG. 16 is a view of the rear of the non-freezing apparatus according to the embodiment of the present invention. Fifth discharge holes 360*a*, 360*b* and 360*c* are formed in a center of the rear surface of the rear outer casing 120 to discharge the flow from the rear space 100R to the cooling space. Some of the cool air introduced from the cooling space to the rear space 100R through the damper 190 is not introduced into the lower space 100L through the discharge grill 172 but discharged again to the cooling space through the fifth discharge holes 360*a*, 360*b* and 360*c*.

In the meantime, a plurality of ribs 125 are formed on the rear surface of the rear outer casing 120. The ribs 125 serve to leave a spacing between the rear surface of the rear outer casing 120 and the installation surface. When the non-freezing apparatus 2000 is installed in the refrigerator 1000 like the embodiment of the present invention, the ribs 125 maintain a spacing between the inner surface of the refrigerator 1000 and the rear surface of the rear outer casing 120. The inner surface of the refrigerator 1000 includes the inner surfaces of the freezing chamber door 1100 and the refrigerating chamber door 1200. In addition, a separate rib 126 is provided to enclose the fifth discharge holes 360*a*, 360*b* and 360*c* formed in the center of the rear surface of the rear outer casing 120 so that the flow discharged through the fifth discharge holes 360*a*, 360*b* and 360*c* of the rear outer casing 120 can be guided to the lower portion of the rear outer casing 120. The separate rib 126 encloses the fifth discharge holes 360*a*, 360*b* and 360*c* in three sides except the lower side such that the flow discharged through the fifth discharge holes 360*a*, 360*b* and 360*c* is naturally guided to the lower side of the non-freezing apparatus 2000.

The present invention has been described in connection with the exemplary embodiments and the accompanying drawings. However, the scope of the present invention is not limited thereto but is defined by the appended claims.

The invention claimed is:

1. A refrigerator, the refrigerator comprising:

a storage casing enclosing a storing space to store a container, the storing space composed of an upper space, a lower space and a separation film located between the upper space and the lower space, the separation film separating upper and lower portions of the container and including a hole through which at least a portion of the container to be stored can pass, the air or heat exchange being limited between the upper space and the lower space;

a cooling circuit having a compressor and an evaporator;

a temperature sensor sensing a temperature of at least one of the upper space and the lower space;

a heat source supplier supplying heat to the upper space or generating heat in the upper space; and a control unit configured to:

control the heat source supplier based on the sensed temperature from the temperature sensor to maintain the temperature of the upper space to be higher than the temperature of the lower space, and control the cooling circuit to maintain the temperature of the lower space to be below the temperature of a maximum ice crystal formation zone of water and the temperature of the upper space to be over the temperature of the maximum ice crystal formation zone of water, thus maintaining a supercooled state of a stored liquid in the container as a preset state during a first time period.

2. The refrigerator of claim 1, wherein the temperature of the upper space is maintained to be higher than a phase transition temperature of water.

3. The refrigerator of claim 1, wherein the control unit is further configured to raise the temperature of the storage space after the first time period, when the liquid stored in the container is released from the supercooled state and is crystallized into slush.

4. The refrigerator of claim 3, wherein the control unit is further configured to release the supercooled state by using electric shock or vibration shock which causes the liquid stored in the container to be crystallized into slush.

5. The refrigerator of claim 1, comprising a fan circulating the air in the lower space by forcible convection.

6. The refrigerator of claim 5, comprising a damper which opens and closes to introduce the cool air from the cooling space to the lower space or intercepting the cool air.

7. The refrigerator of claim 5, wherein the heat source supplier comprises an upper heat source supplier installed at the upper portion of the storing space and a lower heat source supplier installed at the lower portion of the storing space.

8. The refrigerator of claim 7, wherein the temperature control apparatus controls the upper heat source supplier and the lower heat source supplier based on the temperature of the temperature sensor.

* * * * *